US007675472B2

(12) United States Patent
Mikami et al.

(10) Patent No.: US 7,675,472 B2
(45) Date of Patent: Mar. 9, 2010

(54) VEHICLE-MOUNTED ANTENNA SYSTEM

(75) Inventors: Seishin Mikami, Toyota (JP); Akihiko Hayashi, Ogaki (JP); Yuji Yoshida, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/417,296

(22) Filed: May 2, 2006

(65) Prior Publication Data

US 2006/0262018 A1 Nov. 23, 2006

(30) Foreign Application Priority Data

May 18, 2005 (JP) ..... 2005-145684
Mar. 8, 2006 (JP) ..... 2006-062692

(51) Int. Cl.
*H01Q 1/32* (2006.01)
*H01Q 21/00* (2006.01)
*H01Q 1/48* (2006.01)

(52) U.S. Cl. ..... 343/713; 343/725; 343/846

(58) Field of Classification Search ..... 343/711, 343/713, 700 MS, 712, 715, 725, 846
See application file for complete search history.

(56) References Cited

U.S. PATENT DOCUMENTS 5,300,936 A 4/1994 Izadian
6,133,883 A * 10/2000 Munson et al. ..... 343/700 MS
6,157,344 A 12/2000 Bateman et al.
6,246,368 B1 * 6/2001 Deming et al. ..... 343/700 MS
6,774,849 B2 * 8/2004 Umehara et al. ..... 343/700 MS
7,202,826 B2 * 4/2007 Grant et al. ..... 343/713
2004/0140940 A1 7/2004 Vothknecht et al.
2005/0012670 A1 1/2005 Mathiae et al.

FOREIGN PATENT DOCUMENTS

EP 0590955 A3 11/1999
EP 0 989 629 3/2000
EP 1478051 A1 11/2004
JP 2000-307341 11/2000
JP 2001-345620 12/2001

(Continued)

OTHER PUBLICATIONS

Office action dated Oct. 29, 2008 in UK Application No. 0609517.8.

(Continued)

*Primary Examiner*—Hoang V Nguyen
*Assistant Examiner*—Robert Karacsony
(74) *Attorney, Agent, or Firm*—Harness, Dickey & Pierce, PLC

(57) ABSTRACT

A vehicle-mounted antenna system includes a combined antenna apparatus that has a GPS antenna and a short-range wireless communication antenna. The GPS antenna is directional in a vertical direction and the short-range wireless communication antenna is directional in a horizontal direction. The combined antenna apparatus is mounted below an instrument panel of the vehicle by a mounting bracket in such a manner that the short-range wireless communication antenna is directional in the horizontal direction toward an interior of a vehicle. This approach ensures adequate performance of the short-range wireless communication antenna and standardizes a manner in which the short-range wireless communication antenna is mounted to the vehicle.

20 Claims, 3 Drawing Sheets

FOREIGN PATENT DOCUMENTS

| | | |
|---|---|---|
| JP | 2003-280815 | 10/2003 |
| JP | 2003-298340 | 10/2003 |
| JP | 2004-128940 | 4/2004 |
| JP | 2004-147282 | 5/2004 |
| JP | 2004-328330 | 11/2004 |
| WO | WO 96/35241 | 11/1996 |

OTHER PUBLICATIONS

Examination Report dated Apr. 24, 2009 in the corresponding Chinese patent application No. 200610084790.1 with English translation.

Office action dated Nov. 17, 2009 in corresponding Japanese Application No. 2006-062692.

* cited by examiner

VEHICLE-MOUNTED ANTENNA SYSTEM

CROSS REFERENCE TO RELATED APPLICATION

This application is based on and incorporates herein by reference Japanese Patent Applications No. 2005-145684 filed on May 18, 2005, and No. 2006-62692 filed on Mar. 8, 2006.

FIELD OF THE INVENTION

The present invention relates to a vehicle-mounted antenna system including a combined antenna apparatus that has a global positioning system antenna and a short-range wireless communication antenna.

BACKGROUND OF THE INVENTION

An example of a short-range wireless communication antenna for in-vehicle communication is a Bluetooth antenna for Bluetooth communication. Bluetooth is a registered trademark.

In one type of in-vehicle Bluetooth communication system, the Bluetooth antenna and a Bluetooth module including a high frequency circuit, a signal processing circuit, and a power supply circuit are mounted on a single circuit board, and thus assembled as a Bluetooth sub-assembly. The Bluetooth sub-assembly is built in an in-vehicle display.

In another type of in-vehicle Bluetooth communication system, the Bluetooth antenna is separated from the Bluetooth module and mounted behind a front wall of an instrument panel of a vehicle to ensure adequate performance of the Bluetooth antenna. This type is generally used when the vehicle has no in-vehicle display.

As described above, the manner in which the Bluetooth antenna is mounted to the vehicle depends on whether the vehicle has the in-vehicle display. Further, the manner needs to be changed depending on shape and material of equipment of the vehicle in order to prevent a metal part of the vehicle from affecting the Bluetooth antenna. Therefore, the manner varies from one type of vehicle to another.

Recently, there has been an increased demand for short-range wireless communication (e.g., hands free communication) in the vehicle. In view of the increased demand, an increase in development time and design time of the in-vehicle Bluetooth communication system may be caused by the fact that the manner in which the Bluetooth antenna is mounted to the vehicle varies from one type of vehicle to another. Accordingly, manufacturing cost of the in-vehicle Bluetooth communication system may be increased.

In a touch panel display disclosed in JP-A-2003-280815, a microstrip antenna is mounted to an upper electrode plate of the display. However, this approach cannot overcome the problem of the increase in the development time, the design time, and the manufacturing cost.

SUMMARY OF THE INVENTION

In view of the above-described problem, it is an object of the present invention to provide a vehicle-mounted antenna system including a combined antenna apparatus that has a global positioning system (GPS) antenna for GPS communication and a short-range wireless communication antenna for in-vehicle communication. The vehicle-mounted antenna system ensures adequate performance of the short-range wireless communication antenna and standardizes a manner in which the short-range wireless communication antenna is mounted to a vehicle.

A vehicle-mounted antenna system includes a combined antenna apparatus that has a GPS antenna and a short-range wireless communication antenna such as a Bluetooth antenna. The GPS antenna is directional in a vertical direction and has an antenna base plate for providing a ground plane, and the short-range wireless communication antenna is directional in a horizontal direction and has an antenna element integral with the antenna base plate of the GPS antenna.

A mounting means such as a bracket mounts the combined antenna apparatus in a predetermined position of a vehicle in such a manner that the short-range wireless communication antenna is directional in the horizontal direction toward an interior of a vehicle. The predetermined position keeps the combined antenna apparatus away from a metal part of the vehicle so that the metal part can be prevented from affecting the short-range wireless communication antenna. For example, the combined antenna apparatus is mounted below or above an instrument panel made of a non-metallic material such as resin. Thus, adequate performance of the short-range wireless communication antenna can be ensured.

In the vehicle-mounted antenna system, the GPS antenna and the short-range wireless communication antenna are combined together. Accordingly, a manner in which the short-range wireless communication antenna is mounted to the vehicle depends on a manner in which the GPS antenna is mounted to the vehicle. This approach standardizes the manner in which the short-range wireless communication antenna is mounted to the vehicle, thus reducing development time, design time, and manufacturing cost of the vehicle-mounted antenna system.

Whereas the GPS antenna is directional in the vertical direction, the short-range wireless communication antenna is directional in the horizontal direction. Therefore, adequate isolation between the GPS antenna and the short-range wireless communication antenna can be achieved. The antenna element of the short-range wireless communication antenna is integral with the antenna base plate of the GPS antenna so as to be easily manufactured.

BRIEF DESCRIPTION OF THE DRAWINGS

The above and other objectives, features and advantages of the present invention will become more apparent from the following detailed description made with reference to the accompanying drawings. In the drawings.

DETAILED DESCRIPTION OF THE PREFERRED EMBODIMENTS

First Embodiment

Figure 2:
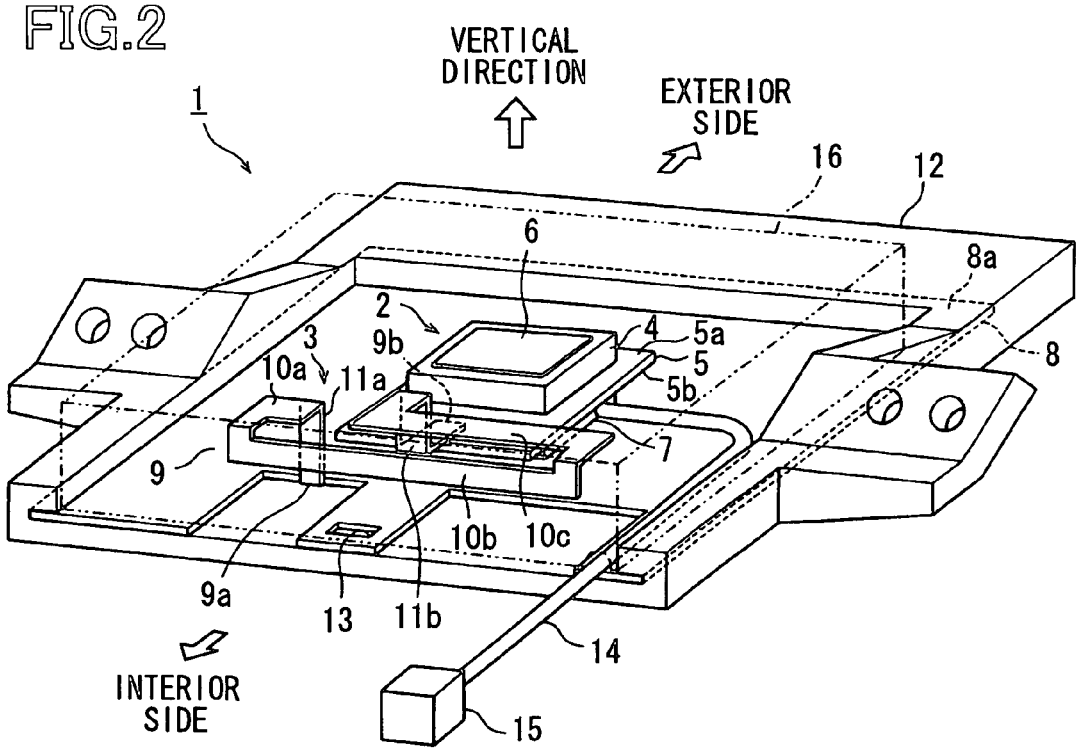
FIG. 2 is a perspective view showing the combined antenna apparatus of FIG. 1 attached to a bracket for mounting the combined antenna apparatus to a vehicle.
Figure 3:
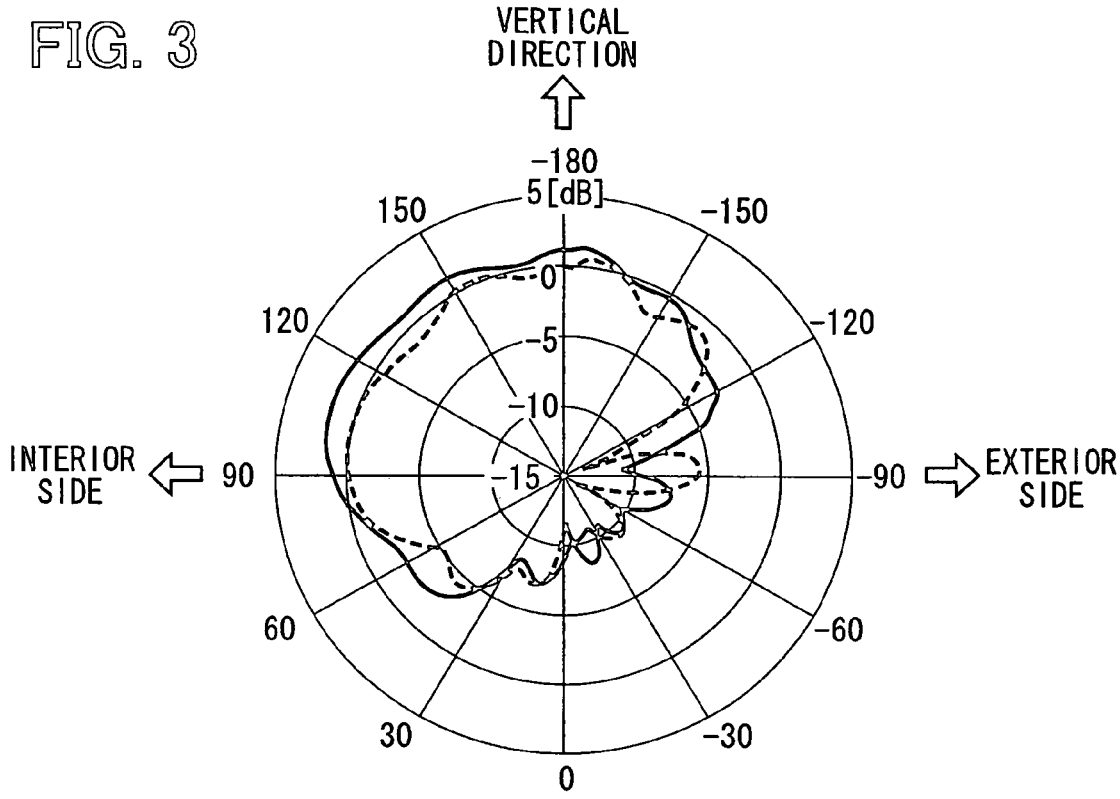
FIG. 3 is a graph illustrating a radiation pattern of a Bluetooth antenna of the combined antenna apparatus of FIG. 1.

A vehicle-mounted antenna system according to a first embodiment of the present invention will now be described with reference to FIGS. 1 to 3.

The vehicle-mounted antenna system includes a combined antenna apparatus 1 that has a GPS antenna 2 for GPS communication and a Bluetooth antenna 3 for Bluetooth communication.

Figure 1:
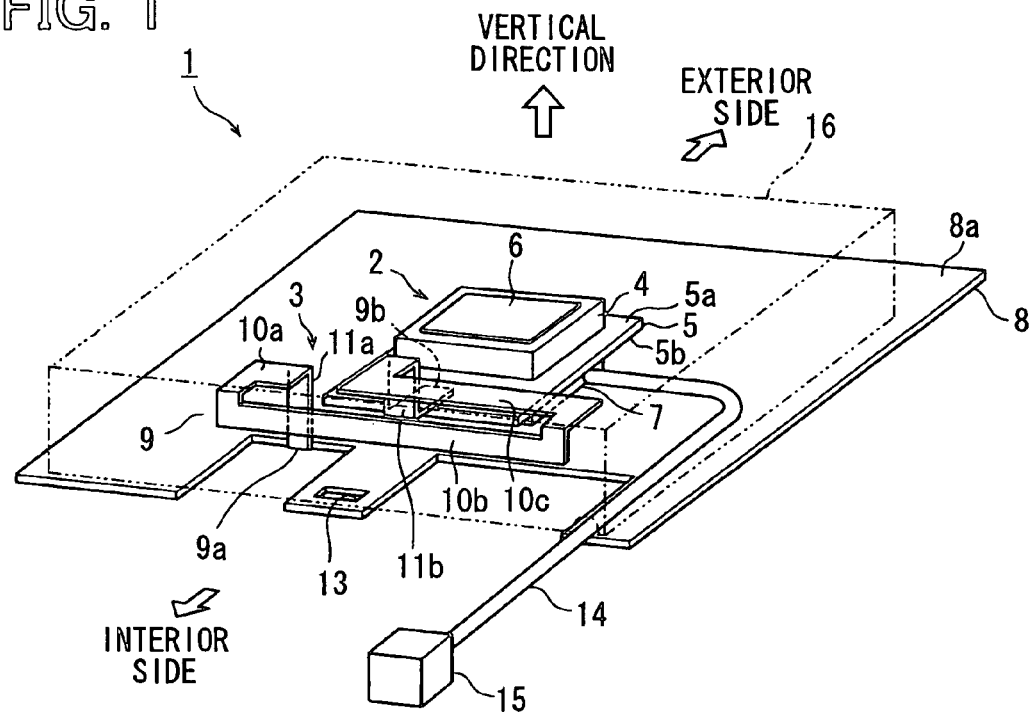
FIG. 1 is a perspective view showing a combined antenna apparatus of a vehicle-mounted antenna system according to a first embodiment of the present invention.

As shown in FIG. 1, the GPS antenna 2 includes a dielectric member 4, a printed circuit board 5, a GPS antenna element 6 having a plate-like shape, and a protective shielding 7 having a rectangular shape. The dielectric member 4 may be, for example, made of ceramics or resin that has low dielectric loss at high frequency. The printed circuit board 5 has a front surface 5*a* on which the dielectric member 4 is mounted and a back surface 5*b* on which electronic components (e.g., a low noise amplifier) for constructing a receiver circuit are mounted. The electronic components are covered with the shielding 7. The GPS antenna element 6 is mounted on the dielectric member 4. The dielectric member 4, the printed circuit board 5, the GPS antenna element 6, and the shielding 7 are located together approximately in a center of an antenna base plate 8. The GPS antenna 2 is directional in a vertical direction, i.e., the GPS antenna 2 receives radio wave more effectively in the vertical direction than others.

The Bluetooth antenna 3 has a Bluetooth antenna element 9 that is integrally formed with the antenna base plate 8 in such a manner that the Bluetooth antenna element 9 rises upwardly from a ground plane 8*a* of the antenna base plate 8. The Bluetooth antenna element 9 of the Bluetooth antenna 3 includes horizontal portions 10*a*-10*c* each of which is substantially horizontal (i.e., parallel) to the ground plane 8*a* and vertical portions 11*a*, 11*b* each of which is substantially vertical (i.e., perpendicular) to the ground plane 8*a*. The horizontal portions 10*a*-10*c* transmit and receive horizontally polarized radio waves and the vertical portions 11*a*, 11*b* transmit and receive vertically polarized radio waves. The Bluetooth antenna 3 is directional in a horizontal direction, i.e., the Bluetooth antenna 3 transmits and receives the radio waves more effectively in the horizontal direction than others. The Bluetooth antenna element 9 has one end 9*a* integrally joined to the antenna base plate 8 and the other end 9*b* soldered to the antenna base plate 8.

When the radio waves used in the Bluetooth communication has a wavelength of L, overall length (i.e., length from the one end 9*a* to the other end 9*b*) of the Bluetooth antenna element 9 is set approximately equal to length of (L/2)N, where N is an integer.

The antenna base plate 8 is cut out such that the antenna base plate 8 has two cutout portions above which the horizontal portions 10*a*-10*c* of the Bluetooth antenna element 9 are positioned. A remaining portion between the cutout portions has a mounting hole 13. As shown in FIG. 2, the combined antenna apparatus 1 is attached to a mounting bracket 12 as a mounting means for mounting the combined antenna apparatus 1 to the vehicle. In this case, a hook (not shown) of the bracket 12 is fixed to the mounting hole 13. The bracket 12 is made of a no-metallic material such as resin.

A coaxial cable 14 includes a GPS cable for the GPS communication and a Bluetooth cable for the Bluetooth communication. The coaxial cable 14 has a connector 15. Each of the GPS antenna 2 and the Bluetooth antenna 3 can be connected to, for example, a navigation system (not shown) and a Bluetooth radio system (not shown) through the connector 15. An inner conductor of the coaxial cable 14 is connected to the electronic components, which construct the receiving circuit, mounted to the printed circuit board 5 and connected to the other end 9*b* of the Bluetooth antenna element 9 of the Bluetooth antenna 3 through the printed circuit board 5. Thus, each of the electronic components and the Bluetooth antenna element 9 can be supplied with electrical power through the coaxial cable 14.

The GPS antenna 2 and the Bluetooth antenna 3 are covered with a radar dome (radome) 16 made of resin that has low dielectric loss in frequency ranges used in the GPS communication and the Bluetooth communication. The radome 16 provides mechanical protection and electrical insulation to the GPS antenna 2 and the Bluetooth antenna 3. The antenna base plate 8 is a large surface area to ensure adequate performance of the GPS antenna 2. Accordingly, size of the antenna base plate 8 is larger than that of the radome 16.

As described above, the combined antenna apparatus 1 has the GPS antenna 2 and the Bluetooth antenna 3 that are combined together and covered with the radome 16. The combined antenna apparatus 1 is attached to the bracket 12 and mounted to the vehicle by means of the bracket 12.

In the vehicle-mounted antenna system according to the first embodiment of the present invention, the combined antenna apparatus 1 is mounted in a predetermined position of the vehicle in such a manner that the Bluetooth antenna 3 is directional in the horizontal direction toward an interior of the vehicle. The predetermined position keeps the combined antenna apparatus 1 away from the metal part of the vehicle. For example, the combined antenna apparatus 1 is mounted below or above an instrument panel (not shown) made of a non-metallic material such as resin. In this case, the GPS antenna 2 is arranged on an exterior side of the vehicle and the Bluetooth antenna 3 is arranged on an interior side of the vehicle.

The present inventors have measured a radiation pattern of the Bluetooth antenna 3 of the combined antenna apparatus 1. FIG. 3 is a graph illustrating the result of the measurement. In the graph, a solid line represents a case where the antenna base plate 8 has the cutout portions above which the horizontal portions 10*a*-10*c* of the Bluetooth element 9 are positioned, and a dashed line represents a case where the antenna base plate 8 has no cutout portions. As can be seen from the graph, when the antenna base plate 8 has the cutout portions, the Bluetooth antenna 3 has an increased gain in the horizontal direction toward the interior of the vehicle.

In the vehicle-mounted antenna system according to the first embodiment, the combined antenna apparatus 1 has the GPS antenna 2 that is directional in the vertical direction and the Bluetooth antenna 3 that is directional in the horizontal direction. The GPS antenna 2 and the Bluetooth antenna 3 are combined together.

The combined antenna apparatus 1 is mounted in the predetermined position that keeps the combined antenna apparatus 1 away from the metal part of the vehicle so that the combined antenna apparatus 1 can be prevented from being affected by the metal part. Further, the combined antenna apparatus 1 is mounted in the position in such a manner that the Bluetooth antenna 3 is directional in the horizontal direction toward the interior of the vehicle. Therefore, the adequate performance of the Bluetooth antenna 3 can be ensured.

Because the GPS antenna 2 and the Bluetooth antenna 3 are combined together, a manner in which the Bluetooth antenna 3 is mounted to the vehicle depends on a manner in which the GPS antenna 2 is mounted to the vehicle. This approach standardizes the manner in which the Bluetooth antenna 3 is mounted to the vehicle, thus reducing development time, design time, and manufacturing cost of the vehicle-mounted antenna system.

Whereas the GPS antenna 2 is directional in the vertical direction, the Bluetooth antenna 3 is directional in the horizontal direction. Therefore, adequate isolation between the GPS antenna 2 and the Bluetooth antenna 3 can be achieved.

The Bluetooth antenna element 9 of the Bluetooth antenna 3 is integrally formed with the antenna base plate 8 of the GPS antenna 2 so that the Bluetooth antenna element 9 can be easily manufactured.

The Bluetooth antenna element 9 includes the horizontal portions 10*a*-10*c* and the vertical portions 11*a*, 11*b*. Therefore, the Bluetooth antenna 3 can transmit and receive each of the horizontally polarized waves and the vertically polarized waves so that the adequate performance of the Bluetooth antenna 3 can be improved.

Because the Bluetooth antenna element 9 rises upwardly from the ground plane 8*a* of the antenna base plate 8, length or width of the combined antenna apparatus 1 can be reduced.

The antenna base plate 8 has the cutout portions so that overlapping area between the horizontal portions 10*a*-10*c* and the antenna base plate 8 can be reduced. Thus, the cutout portions prevent the antenna base plate 8 from affecting the horizontal portions 10*a*-10*c* so that the adequate performance of the Bluetooth antenna 3 can be ensured.

When the combined antenna apparatus 1 is attached to the bracket 12, the cutout portions of the antenna base plate 8 is covered with the bracket 12 so as to prevent foreign matter such as dust from entering the combined antenna apparatus 1 through the cutoff portions.

Because the Bluetooth antenna 3 is mounted on the interior side of the vehicle, a distance between the Bluetooth antenna 3 and the navigation system or the Bluetooth radio system can be reduced to a minimum. Therefore, the adequate performance of the Bluetooth antenna 3 can be ensured.

The GPS antenna 2 is mounted to the vehicle in the conventional manner in which the GPS antenna 2 is mounted below the instrument panel of the vehicle. Therefore, the vehicle-mounted antenna system can be achieved with minor changes.

Compared to the manner in which the Bluetooth antenna is mounted behind the front wall of the instrument panel, the Bluetooth antenna 3 is kept away from a resin (i.e., dielectric) part of the vehicle. Thus, the resin part can be prevented from shortening the wavelength of the radio waves so that the adequate performance of the Bluetooth antenna 3 can be ensured.

Second Embodiment

Figure 4:
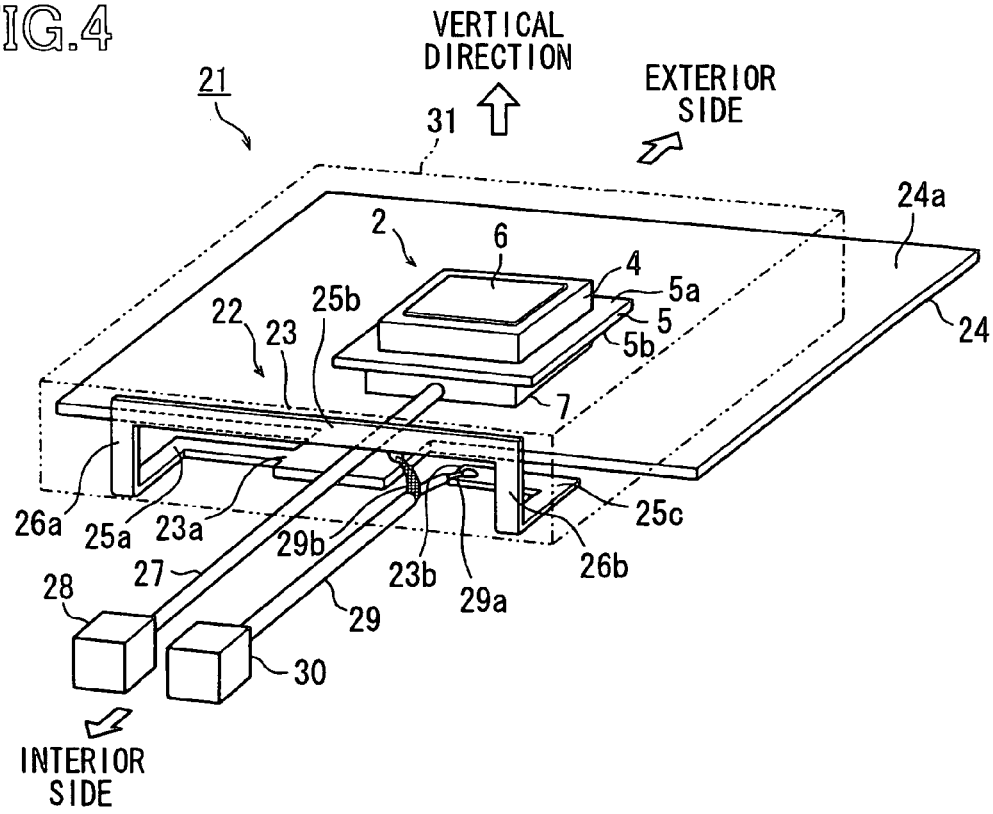
FIG. 4 is a perspective view showing a combined antenna apparatus of a vehicle-mounted antenna system according to a second embodiment of the present invention.
Figure 5:
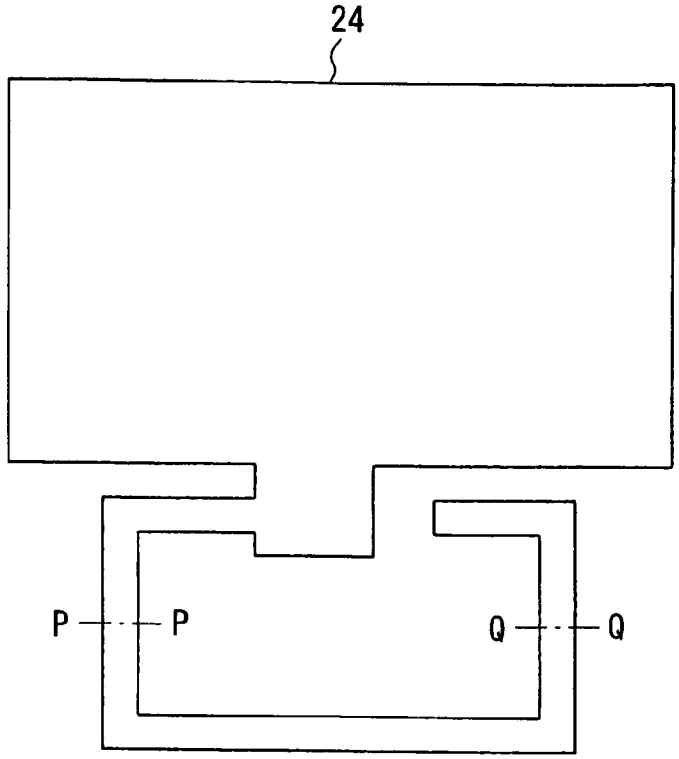
FIG. 5 is a plan view showing a metal plate for providing an antenna base plate of a GPS antenna and an antenna element of a Bluetooth antenna of the combined antenna apparatus of FIG. 4.
Figure 6:
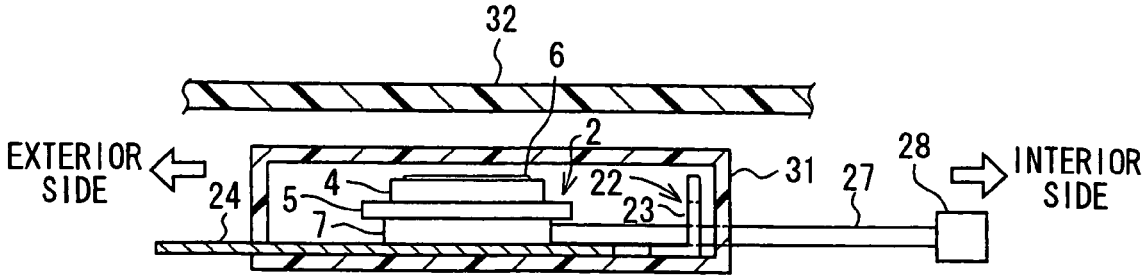
FIG. 6 is a schematic cross-sectional view showing a manner in which the combined antenna apparatus of FIG. 4 is mounted below an instrument panel of the vehicle.

A vehicle-mounted antenna system according to a second embodiment of the present invention will now be described with reference to FIGS. 4 to 6.

The vehicle-mounted antenna system according to the second embodiment includes a combined antenna apparatus 21 that has a GPS antenna 2 for the GPS communication and a Bluetooth antenna 22 for the Bluetooth communication.

The Bluetooth antenna 22 has a Bluetooth antenna element 23 that is integrally formed with an antenna base plate 24 in such a manner that the Bluetooth antenna element 23 projects from the antenna base plate 24 in a horizontal direction toward an interior of a vehicle. Specifically, the antenna base plate 24 is formed in a shape shown in FIG. 5 and then bent along two lines P-P, Q-Q shown in FIG. 5. Thus, the Bluetooth antenna element 23 is integral with the antenna base plate 24.

The Bluetooth antenna element 23 of the Bluetooth antenna 22 includes horizontal portions 25*a*-25*c* each of which is substantially horizontal (i.e., parallel) to a ground plane 24*a* of the antenna base plate 24 and vertical portions 26*a*, 26*b* each of which is substantially vertical (i.e., perpendicular) to the ground plane 24*a*. The horizontal portions 25*a*-25*c* transmit and receive horizontally polarized radio waves and the vertical portions 26*a*, 26*b* transmit and receive vertically polarized radio waves. The Bluetooth antenna 22 is directional in the horizontal direction.

When radio waves used in the Bluetooth communication has a wavelength of L, overall length (i.e., length from one end 23*a* to the other end 23*b*) of the antenna element 23 is set approximately equal to length of (L/2)N, where N is an integer.

A GPS coaxial cable 27 connected to the GPS antenna 2 has a connector 28. The GPS antenna 2 can be connected to, for example, an in-vehicle navigation system (not shown) and an in-vehicle Bluetooth radio system (not shown) through the connector 28. The GPS coaxial cable 27 has an inner conductor connected to the electronic components, which construct the receiving circuit, mounted to the printed circuit board 5. Thus, the electronic components are supplied with electrical power through the GPS coaxial cable 27.

A Bluetooth coaxial cable 29 connected to the Bluetooth antenna 22 has a connector 30. The Bluetooth antenna 22 can be connected to, for example, the navigation system and the Bluetooth radio system through the connector 30. An inner conductor 29*a* of the Bluetooth coaxial cable 29 is connected to the other end 23*b* of the Bluetooth element 23 so that the Bluetooth element 23 can be supplied with electric power through the Bluetooth coaxial cable 29. An outer conductor 29*b* of the Bluetooth coaxial cable 29 is connected to the antenna base plate 24.

The GPS antenna 2 and the Bluetooth antenna 22 are covered with a radome 31 made of resin that has low dielectric loss in frequency ranges used in the GPS communication and the Bluetooth communication. The radome 31 provides mechanical protection and electrical insulation to the GPS antenna 2 and the Bluetooth antenna 22. The antenna base plate 24 has a large surface area so that the GPS antenna 2 can have adequate performance. Accordingly, size of the antenna base plate 24 is larger than that of the radome 31.

As described above, the combined antenna apparatus 21 has the GPS antenna 2 and the Bluetooth antenna 22 that are combined together and covered with the radome 31.

In the vehicle-mounted antenna system according to the second embodiment of the present invention, the combined antenna apparatus 21 is mounted in a predetermined position that keeps the combined antenna apparatus 21 away from metal parts of the vehicle so that the metal part can be prevented from affecting the combined antenna apparatus 21. For example, as shown in FIG. 6, the combined antenna apparatus 21 is mounted below an instrument panel 32 made of a non-metallic material such as resin.

Further, the combined antenna apparatus 21 is mounted in such a manner that the Bluetooth antenna 22 is directional in the horizontal direction toward the interior of the vehicle. As shown in FIG. 6, the GPS antenna 2 is arranged on an exterior side of the vehicle and the Bluetooth antenna 22 is arranged on an interior side of the vehicle. Thus, the adequate performance of the Bluetooth antenna 22 can be ensured.

Because the GPS antenna 2 and the Bluetooth antenna 22 are combined together, a manner in which the Bluetooth antenna 22 is mounted to the vehicle depends on a manner in which the GPS antenna 2 is mounted to the vehicle. This approach standardizes the manner in which the Bluetooth antenna 22 is mounted to the vehicle, thus reducing development time, design time, and manufacturing cost of the vehicle-mounted antenna system.

The embodiments described above may be modified in various ways. For example, the short-range wireless communication antenna may be a wireless local area network (LAN) antenna for wireless LAN communication or a wireless infrared antenna for wireless infrared communication.

The combined antenna apparatus 1, 21 may be mounted anywhere the metal part can be prevented from affecting the combined antenna apparatus 1, 21. For example, the combined antenna apparatus 1, 21 may be mounted above the instrument panel of the vehicle.

The combined antenna apparatus 1, 21 may communicate with a mobile terminal such as a mobile phone, which an occupant of the vehicle has.

In the combined antenna apparatus 1, the remaining portion between the cutout portions of the antenna base plate 8 may be cut out so as to prevent the horizontal portions 10*a*-10*c* of the Bluetooth antenna element 9 from overlapping the antenna base plate 8. In this case, the mounting hole 13 of the remaining portion may be provided in another portion of the antenna base plate 8.

The combined antenna apparatus 21 may be mounted to the vehicle by means of the bracket 12. Various types of mounting means may be used instead of the bracket 12 for mounting the combined antenna apparatus 1, 21 to the vehicle.

Such changes and modifications are to be understood as being within the scope of the present invention as defined by the appended claims.

What is claimed is:

1. A vehicle-mounted antenna system, comprising:

a combined antenna apparatus including a global positioning system antenna that is directional in a vertical direction and has a single piece metal antenna base plate which provides a ground plane, the single piece metal antenna base plate defining a wireless communication antenna that is directional in a horizontal direction and has an antenna element, the antenna element and the single piece metal antenna base plate being made from the same piece of metal, wherein the single piece metal antenna base plate is not located directly below the antenna element of the integral wireless communication antenna; and the antenna element of the wireless communication antenna includes a vertical portion extending generally perpendicular to the ground plane of the antenna base plate and a horizontal portion extending from one of the vertical portion or the antenna base plate parallel with the ground plane of the antenna base plate in a direction away from the global positioning system antenna.

2. The antenna system according to claim 1, further comprising:

means for mounting the combined antenna apparatus in a predetermined position of a vehicle in such a manner that the wireless communication antenna is directional in the horizontal direction toward an interior of the vehicle, wherein the predetermined position keeps the combined antenna apparatus away from a metal part of the vehicle.

3. The antenna system according to claim 2, wherein the mounting means mounts the combined antenna apparatus below or above an instrument panel of the vehicle, and the instrument panel is made of a non-metallic material.

4. The antenna system according to claim 1, wherein the ground plane of the antenna base plate is substantially horizontal.

5. The antenna system to claim 1, wherein the horizontal portion of the antenna element of the wireless communication antenna extends from the antenna base plate of the global positioning system antenna in the horizontal direction toward an interior of the vehicle.

6. The antenna system according to claim 2, wherein the wireless communication antenna is arranged on an interior side of the vehicle, and the global positioning system antenna is arranged on an exterior side of the vehicle.

7. The antenna system according to claim 1, wherein the horizontal portion is disposed between the vertical portion and the global positioning system antenna.

8. The antenna system of claim 1, wherein the single piece metal antenna base plate is not located directly below any portion of the antenna element.

9. The antenna system of claim 1, wherein the single piece metal antenna base is formed by cuffing a metal plate into a predetermined shape and the antenna element is provided by bending a portion of the single piece metal antenna base plate.

10. The antenna system of claim 1, wherein a bent portion of the single piece metal antenna base plate defines the wireless communication antenna.

11. A vehicle-mounted antenna system, comprising:

a combined antenna apparatus including a global positioning system antenna that is directional in a vertical direction and has a single piece metal antenna base plate which provides a ground plane, the single piece metal antenna base plate defining a wireless communication antenna that is directional in a horizontal direction and has an antenna element, the antenna element and the single piece metal antenna base plate being made from the same piece of metal, wherein the single piece metal antenna base plate is not located directly below the antenna element of the integral wireless communication antenna; and the antenna element of the wireless communication antenna includes a first vertical portion and a second vertical portion extending generally perpendicular to the ground plane of the antenna base plate, the second vertical portion being spaced from the first vertical portion.

12. The antenna system of claim 11, wherein the single piece metal antenna base plate is not located directly below any pardon of the antenna element.

13. The antenna system of claim 11, wherein the single piece metal antenna base is formed by cutting a metal plate into a predetermined shape and the antenna element is provided by bending a portion of the single piece metal antenna base plate.

14. The antenna system of claim 11, wherein a bent portion of the single piece metal antenna base plate defines the wireless communication antenna.

15. A vehicle-mounted antenna system, comprising:

a combined antenna apparatus including a global positioning system antenna that is directional in a vertical direction and has a single piece metal antenna base plate which provides a ground plane, the single piece metal antenna plate defining a wireless communication antenna that is directional in a horizontal direction and has an antenna element, the antenna element and the single piece metal antenna base plate being made from the same piece of metal, wherein the single piece metal antenna base plate is not located directly below the antenna element of the integral wireless communication antenna; and the antenna element of the wireless communication antenna includes a vertical portion extending generally perpendicular to the ground plane of the antenna base plate and a horizontal portion having a first end attached to the antenna base plate and a second end spaced from the first end of the horizontal portion, the first end of the horizontal portion being closer to the global positioning system antenna than the second end of the horizontal portion.

16. The antenna system according to claim 15, wherein the horizontal pardon is disposed generally parallel to the ground plane.

17. The antenna system according to claim 15, wherein the antenna base plate does not define an aperture used to mount the antenna element.

18. The antenna system of claim 15, wherein the single piece metal antenna base plate is not located directly below any portion of the antenna element.

19. The antenna system of claim 15, wherein the single piece metal antenna base plate is formed by cutting a metal plate into a predetermined shape and the antenna element is provided by bending a portion of the single piece metal antenna base plate.

20. The antenna system of claim 15, wherein a bent portion of the single piece metal antenna base plate defines the wireless communication antenna.

* * * * *